US007360372B2

(12) United States Patent
Takechi et al.

(10) Patent No.: US 7,360,372 B2
(45) Date of Patent: Apr. 22, 2008

(54) REFRIGERATION SYSTEM

(75) Inventors: Ryota Takechi, Sakai (JP); Shinya Matsuoka, Sakai (JP); Yasushi Hori, Sakai (JP); Masahiro Oka, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 519 days.

(21) Appl. No.: 10/542,369

(22) PCT Filed: Aug. 23, 2004

(86) PCT No.: PCT/JP2004/012064

§ 371 (c)(1),
(2), (4) Date: Jul. 14, 2005

(87) PCT Pub. No.: WO2005/019742

PCT Pub. Date: Mar. 3, 2005

(65) Prior Publication Data

US 2006/0048539 A1 Mar. 9, 2006

(30) Foreign Application Priority Data

Aug. 25, 2003 (JP) ..... 2003-299859

(51) Int. Cl.
*F25B 41/00* (2006.01)
*F25B 41/04* (2006.01)
*F25B 1/00* (2006.01)

(52) U.S. Cl. ..... 62/208; 62/513; 62/225; 62/229

(58) Field of Classification Search ..... 62/513, 62/208, 197, 225, 324.1, 498, 228.3, 229
See application file for complete search history.

(56) References Cited

U.S. PATENT DOCUMENTS 6,330,909 B1 * 12/2001 Takahashi et al. ..... 165/202

FOREIGN PATENT DOCUMENTS

| | | |
|---|---|---|
| JP | 6-265232 A | 9/1994 |
| JP | 7-4756 A | 1/1995 |
| JP | 2000-18737 A | 1/2000 |

* cited by examiner

*Primary Examiner*—Chen-Wen Jiang
(74) *Attorney, Agent, or Firm*—Global IP Counselors

(57) ABSTRACT

A refrigeration system to increase the subcooling degree of refrigerant flowing through a main refrigerant circuit is provided. The refrigeration system is configured such that a portion of the refrigerant flowing through the main refrigerant circuit can be made to bypass the remainder of the main refrigerant circuit in a bypass refrigerant circuit so as to be returned to the intake side of a compressor and to be used to cool the refrigerant flowing through the main refrigerant circuit to a subcooled state.

12 Claims, 5 Drawing Sheets

REFRIGERATION SYSTEM

TECHNICAL FIELD

The present invention relates to a refrigeration system. More particularly, the present invention relates to a refrigeration system configured such that a portion of the refrigerant flowing through a main refrigerant circuit can be made to bypass the remainder of the main refrigerant circuit so as to return to the intake side of a compressor and used to cool the refrigerant flowing through the main refrigerant circuit to a subcooled state.

BACKGROUND OF THE INVENTION

Among conventional refrigeration systems provided with a vapor compression type refrigerant circuit, there is an air conditioner design configured such that a portion of the refrigerant flowing through a main refrigerant circuit can be made to bypass the remainder of the main refrigerant circuit so as to return to the intake side of a compressor and used to cool the refrigerant flowing through the main refrigerant circuit to a subcooled state. An air conditioner configured in this fashion is provided with the following: a main refrigerant circuit including a compressor, a heat-source-side heat exchanger and a user-side heat exchanger; a bypass refrigerant circuit connected to the main refrigerant circuit in such a manner that a portion of the refrigerant flowing from the heat-source-side heat exchanger to the user-side heat exchanger branches away from the main refrigerant circuit and returns to the intake side of the compressor; a bypass expansion mechanism that is provided in the bypass refrigerant circuit and configured to regulate the flow rate of the refrigerant flowing through the bypass refrigerant circuit; a cooling device configured to cool the refrigerant flowing from the heat-source-side heat exchanger to the user-side heat exchanger in the main refrigerant circuit using the refrigerant that is returned from the outlet of the bypass expansion mechanism to the intake side of the compressor; a superheating degree detecting mechanism that is provided in the bypass refrigerant circuit and configured to detect the degree of superheating of the refrigerant at the outlet side of the cooling device; and an expansion mechanism control means configured to control the bypass expansion mechanism based on the superheating degree detected by the super heating degree detecting mechanism such that the superheating degree of the refrigerant flowing through the bypass refrigerant circuit is equal to or higher than a prescribed superheating degree.

When an air conditioner configured in this fashion is operated in cooling mode, a portion of the liquid refrigerant that is sent from the heat-source-side heat exchanger to the user-side heat exchanger in the main refrigerant circuit is diverted from the main refrigerant circuit and returned to the intake side of the compressor through the bypass refrigerant circuit (which branches from the main refrigerant circuit) while the flow rate of the diverted refrigerant is adjusted by the bypass expansion mechanism. The refrigerant that flows from the outlet of the bypass expansion mechanism in the bypass refrigerant circuit toward the intake side of the compressor passes through the cooling device and exchanges heat with the liquid refrigerant flowing from the heat-source side heat exchanger to the user-side heat exchanger. After passing through the bypass expansion mechanism, the temperature of refrigerant in the bypass refrigerant circuit is lower than the temperature of the refrigerant flowing from the heat-source-side heat exchanger to the user-side heat exchanger in the main refrigerant circuit. Consequently, the refrigerant in the bypass refrigerant circuit cools the liquid refrigerant flowing from the heat-source-side heat exchanger to the user-side heat exchanger in the main refrigerant circuit and, in turn, is heated. Since the bypass expansion mechanism is controlled by the expansion mechanism control means such that the superheating degree of the refrigerant at the outlet of the cooling device in the bypass refrigerant circuit, i.e., the superheating degree detected by the superheating degree detecting mechanism, is equal to or higher than a prescribed superheating degree, the refrigerant flowing through the bypass refrigerant circuit passes through the cooling device and is heated to the prescribed superheating degree or above before returning to the intake side of the compressor. Meanwhile the refrigerant flowing through the main refrigerant circuit of the cooling device is cooled to a subcooled state corresponding to the amount of heat exchanged with the refrigerant flowing through the bypass refrigerant circuit of the cooling device. In this way, the air conditioner executes superheating degree control in such a manner that the refrigerant flowing through the main refrigerant circuit is cooled to a subcooled state. (See, for example, Japanese Laid-Open Patent Publication No. 07-4756.)

SUMMARY OF THE INVENTION

In an air conditioner like that described above, since the expansion mechanism control means controls the bypass expansion mechanism based on the superheating degree detected by the superheating degree detecting mechanism such that the superheating degree of the refrigerant that bypasses the main refrigerant circuit and passes through the cooling device is equal to or higher than a prescribed superheating degree, the refrigerant that exits the cooling device and returns to the intake side of the compressor has a superheating degree at least as high as the prescribed value when it enters the main refrigerant circuit on the intake side of the compressor. In some cases, such as when the refrigerant flowing through the portion of the main refrigerant circuit on the intake side of the compressor is sufficiently superheated even after the refrigerant from the bypass refrigerant circuit (which has passed through the cooling device) merges therewith, the subcooling degree of the refrigerant flowing through the main refrigerant circuit can feasibly be increased by increasing the flow rate of the refrigerant flowing through the bypass refrigerant circuit, thereby accelerating the exchange of heat in the cooling device. However, since the bypass expansion mechanism is controlled in such a manner that the refrigerant that exits the cooling device and returns to the intake side of the compressor always has a superheating degree at least as high as the prescribed value, the subcooling degree of the refrigerant flowing through the main refrigerant circuit can not be increased by increasing the flow rate of the refrigerant in the bypass refrigerant circuit.

The object of the present invention is to make it possible to increase the subcooling degree of the refrigerant flowing through the main refrigerant circuit in a refrigeration system configured such that a portion of the refrigerant flowing through a main refrigerant circuit can be made to bypass the remainder of the main refrigerant circuit so as to return to the intake side of a compressor and used to cool the refrigerant flowing through the main refrigerant circuit to a subcooled state.

A refrigeration system in accordance with a first aspect is provided with a main refrigerant circuit, a discharge temperature detecting mechanism, a bypass refrigerant circuit, a bypass expansion mechanism, a cooling device, a superheating degree detecting mechanism, and an expansion mechanism control means. The main refrigerant circuit includes a compressor, a heat-source-side heat exchanger, and a user-side heat exchanger. The discharge temperature detecting mechanism is provided in the main refrigerant circuit and configured to detect the discharge temperature of the refrigerant at the discharge side of the compressor. The bypass refrigerant circuit is connected to the main refrigerant circuit and configured such that a portion of the refrigerant flowing from the heat-source-side heat exchanger to the user-side heat exchanger is diverted from the main refrigerant circuit and returned to the intake side of the compressor. The bypass expansion mechanism is provided in the bypass refrigerant circuit and configured to regulate the flow rate of the refrigerant flowing through the bypass refrigerant circuit. The cooling device is configured and arranged to cool the refrigerant flowing from the heat-source-side heat exchanger to the user-side heat exchanger in the main refrigerant circuit using the refrigerant that exits the bypass expansion mechanism and returns to the intake side of the compressor. The superheating degree detecting mechanism is provided in the bypass refrigerant circuit and configured to detect the superheating degree of the refrigerant at the outlet side of the cooling device. The expansion mechanism control means is configured to control the bypass expansion mechanism based on the superheating degree detected by the superheating degree detecting mechanism such that the superheating degree of the refrigerant flowing through the bypass refrigerant circuit is substantially equal to a prescribed superheating degree. The value of the prescribed superheating degree is set based on the discharge temperature detected by the discharge temperature detecting mechanism to such a value that wet compression does not occur in the compressor.

When this air conditioner is operated in cooling mode, a portion of the liquid refrigerant that is sent from the heat-source-side heat exchanger to the user-side heat exchanger in the main refrigerant circuit is returned to the intake side of the compressor through the bypass refrigerant circuit (which branches from the main refrigerant circuit) while the flow rate of the returned refrigerant is regulated by the bypass expansion mechanism. The refrigerant that flows from the outlet of the bypass expansion mechanism in the bypass refrigerant circuit toward the intake side of the compressor passes through the cooling device and exchanges heat with the liquid refrigerant flowing from the heat-source-side heat exchanger to the user-side heat exchanger. After passing through the bypass expansion mechanism, the temperature of refrigerant in the bypass refrigerant circuit is lower than the temperature of the refrigerant flowing from the heat-source-side heat exchanger to the user-side heat exchanger in the main refrigerant circuit. Consequently, the refrigerant in the bypass refrigerant circuit cools the liquid refrigerant flowing from the heat-source-side heat exchanger to the user-side heat exchanger in the main refrigerant circuit and, in turn, is heated. Since, similarly to the conventional refrigeration system described previously, the bypass expansion mechanism is controlled by the expansion mechanism control means such that the superheating degree of the refrigerant at the outlet of the cooling device in the bypass refrigerant circuit, i.e., the superheating degree detected by the superheating degree detecting mechanism, is substantially equal to a prescribed superheating degree, the refrigerant flowing through the bypass refrigerant circuit passes through the cooling device and is heated substantially to the prescribed superheating degree before returning to the intake side of the compressor. Meanwhile, the refrigerant flowing through the main refrigerant circuit side of the cooling device is cooled to a subcooled state corresponding to the amount of heat exchanged with the refrigerant flowing through the bypass refrigerant circuit of the cooling device. However, unlike the conventional refrigeration system, this refrigeration system is configured such that the prescribed superheating degree value used by the expansion mechanism control means to control the bypass expansion mechanism—and, thus, control the superheating degree of the refrigerant flowing through the bypass refrigerant circuit—can be set based on the compressor discharge temperature detected by the discharge temperature detecting mechanism to a value in a range where wet compression does not occur in the compressor.

As a result, when the refrigerant flowing through the portion of the main refrigerant circuit on the intake side of the compressor is sufficiently superheated even after the refrigerant from the bypass refrigerant circuit (which has passed through the cooling device) merges therewith, the flow rate of the refrigerant flowing through the bypass refrigerant circuit can be increased by reducing the value of the prescribed superheating degree to an extent that does not cause wet compression in the compressor. Thus, the exchange of heat in the cooling device can be accelerated and the subcooling degree of the refrigerant flowing through the main refrigerant circuit can be increased.

A refrigeration system in accordance with a second aspect is a refrigeration system according to the first aspect, wherein when the discharge temperature detected by the discharge temperature detecting mechanism is equal to or higher than a prescribed value, the expansion mechanism control means controls the bypass expansion mechanism such that said discharge temperature is reduced to a temperature lower than the prescribed value.

With this refrigeration system, when the discharge temperature detected by the discharge temperature detecting mechanism is smaller than a prescribed value, the expansion mechanism control means controls the bypass expansion mechanism such that the superheating degree of the refrigerant flowing through the bypass refrigerant circuit is kept within a range where wet compression does not occur in the compressor. Meanwhile, when the discharge temperature detected by the discharge temperature detecting mechanism is equal to or higher than the prescribed value, instead of controlling the superheating degree of the refrigerant flowing through the bypass refrigerant circuit, the expansion mechanism control means controls the bypass expansion mechanism such that the discharge temperature detected by the discharge temperature detecting mechanism decreases to a temperature lower than the prescribed value.

As a result, control that prevents the compressor from operating in an overheated state can be executed while executing control that increases the subcooling degree of the refrigerant flowing through the main refrigerant circuit by controlling the superheating degree of the refrigerant flowing through the bypass refrigerant circuit. Additionally, the cost of the refrigeration system can be reduced because it is not necessary to provide a separate refrigerant circuit for preventing overheating of the compressor.

A refrigeration system in accordance with a third aspect is a refrigeration system according to the first or second aspect, wherein the cooling device is a heat exchanger having flow passages configured such that the refrigerant flowing through the main refrigerant circuit side of the heat exchanger flows in a direction that opposes the flow direction of the refrigerant flowing through the bypass refrigerant circuit side.

With this refrigeration system, the refrigerant flowing through the main refrigerant circuit side can be cooled to a temperature that is lower than the temperature of the refrigerant at the outlet of the bypass refrigerant circuit side of the heat exchanger because the cooling device is configured such that the refrigerant flowing through the main refrigerant circuit side thereof flows in a direction that opposes the flow direction of the refrigerant flowing through the bypass refrigerant circuit side.

As a result, the cold energy of the refrigerant flowing through the bypass refrigerant circuit is used more efficiently and the subcooling degree of the refrigerant flowing through the main refrigerant circuit can be increased even further.

A refrigeration system in accordance with a fourth aspect is a refrigeration system in accordance with any one of the first to third aspects, wherein the main refrigerant circuit comprises a heat source unit including the compressor, heat-source-side heat exchanger, and cooling device and a user unit including the user-side heat exchanger, said units being connected together by a liquid refrigerant communication pipe and a gaseous refrigerant communication pipe. The user unit has a user-side expansion mechanism that is connected to the liquid refrigerant communication pipe side of the user-side heat exchanger and is configured to regulate the flow rate of the refrigerant flowing through the user unit.

When this refrigeration system is operating in cooling mode, the condensed refrigerant leaving the heat-source-side heat exchanger is subcooled by the cooling device and delivered to the user unit via the liquid refrigerant communication pipe, after which it is expanded inside the user unit.

As a result, the refrigerant flowing through the liquid refrigerant communication pipe can be prevented from evaporating due to low pressure and turning into a two-phase refrigerant flow even if the liquid refrigerant communication pipe is long or the user unit is installed in a higher position than the heat source unit. Consequently, abnormal noises occurring as the refrigerant passes through the user-side expansion mechanism of the user unit can be suppressed.

A refrigeration system in accordance with a fifth aspect is a refrigeration system according to the fourth aspect, wherein a plurality of user units are provided, the user units being arranged in parallel and connected to the heat source unit via the liquid refrigerant communication pipe and the gaseous refrigerant communication pipe.

In this refrigeration system, a plurality of user units are arranged in parallel with one another and connected to the heat source unit via the liquid refrigerant communication pipe and the gaseous refrigerant communication pipe. During cooling mode, the condensed refrigerant leaving the heat-source-side heat exchanger is subcooled by the cooling device and delivered to the user units via the liquid refrigerant communication pipe in a branched manner.

As a result, the refrigerant flowing through the liquid refrigerant communication pipe can be prevented from evaporating due to low pressure and turning into a two-phase refrigerant flow and the occurrence of an uneven flow distribution of refrigerant to the user units can be prevented.

BRIEF DESCRIPTIONS OF THE DRAWINGS

DETAILED DESCRIPTION

Figure 1:
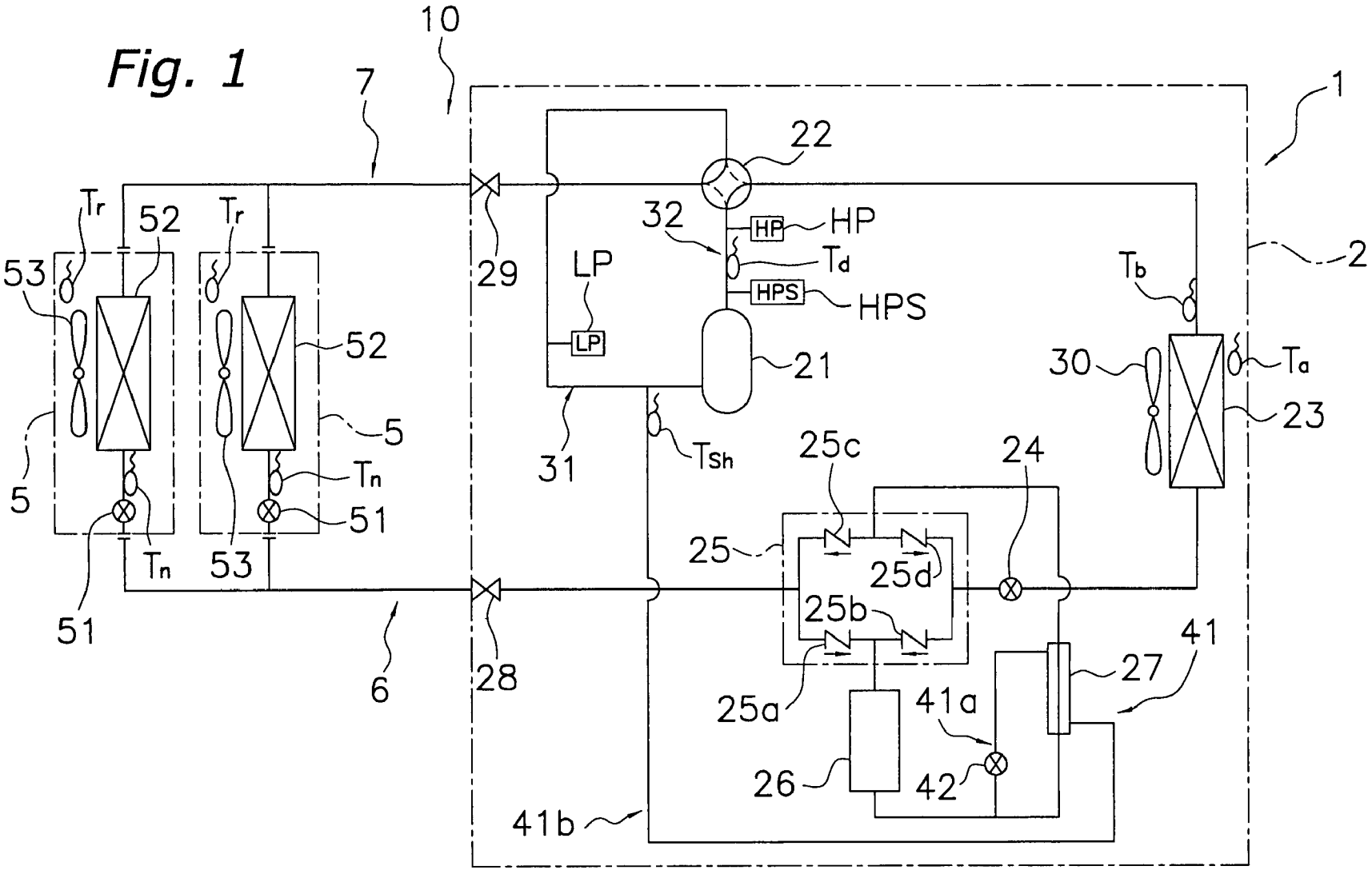
FIG. 1 is a schematic diagram of the refrigerant circuit of an air conditioner that serves as an embodiment of a refrigeration system in accordance with the present invention.

FIG. 1 is a schematic diagram of the refrigerant circuit of an air conditioner 1 that serves as an embodiment of a refrigeration system in accordance with the present invention. The air conditioner 1 is intended for heating and cooling of office buildings and includes one heat source unit 2, a plurality of (two in this embodiment) user units 5 connected in parallel, and a liquid refrigerant communication pipe 6 and a gaseous refrigerant pipe 7 for connecting the heat source unit 2 and the user unit 5 together.

Each user unit 5 comprises chiefly a user-side expansion valve 51 (user-side expansion mechanism), a user-side heat exchanger 52, and piping connecting these components together. In this embodiment, the user-side expansion valve 51 is an electric powered expansion valve connected to the liquid side of the user-side heat exchanger 52 for the purpose of regulating the pressure and flow rate of the refrigerant. In this embodiment, the user-side heat exchanger 52 is a cross fin tube type heat exchanger serving to exchange heat with the air inside the room. In this embodiment, the user unit 5 is equipped with an indoor fan 53 for drawing air from the room into the unit and blowing it back out so that heat can be exchanged between the air in the room and the refrigerant flowing through the user-side heat exchanger 52.

The heat source unit 2 comprises chiefly a compressor 21, a four-way selector valve 22, a heat-source-side heat exchanger 23, a heat-source-side expansion valve 24, a bridge circuit 25, a receiver 26, a cooling device 27, a bypass refrigerant circuit 41, a liquid refrigerant shut off valve 28, a gaseous refrigerant shut-off valve 29, and refrigerant piping for connecting these components together.

In this embodiment, the compressor 21 is a scroll type compressor that is driven by an electric motor and serves to compress the gaseous refrigerant it draws into itself.

The four-way selector valve 22 is configured such that it can change the flow direction of the refrigerant when the air conditioner is switched between cooling mode and heating mode. During cooling mode, it connects the discharge side of the compressor 21 to the gas side of the heat-source-side heat exchanger 23 and connects the intake side of the compressor 21 to the gaseous refrigerant shut-off valve 29 (indicated with solid lines in the four-way selector valve 22 shown in FIG. 1). Meanwhile, during heating mode, it connects the discharge side of the compressor 21 to the gaseous refrigerant shut-off valve 29 and connects the intake side of the compressor 21 to the gas side of the heat-source-side heat exchanger 23 (indicated with broken lines in the four-way selector valve 22 shown in FIG. 1).

In this embodiment, the heat-source-side heat exchanger 23 is a cross fin tube type heat exchanger configured to exchange heat between the refrigerant and air, the air serving as a heat source. In this embodiment, the heat source unit 2 is equipped with an outdoor fan 30 for drawing outdoor air into the unit and blowing it back out so that heat can be exchanged between the outdoor air and the refrigerant flowing through the heat-source-side heat exchanger 23.

In this embodiment, the heat-source-side expansion valve 24 is an electric powered expansion valve configured and arranged to regulate the flow rate of the refrigerant flowing between the heat-source-side heat exchanger 23 and the user-side heat exchangers 52.

The receiver 26 is a container for temporarily collecting refrigerant flowing between the heat-source-side heat exchanger 23 and user-side heat exchangers 52. The receiver 26 has an inlet provided on an upper portion of the container and an outlet provided on a lower portion of the container. The inlet of the receiver 26 is connected to the heat-source-side expansion valve 24 and the liquid refrigerant shut-off valve 28 through the bridge circuit 25. The outlet of the receiver 26 is connected to the cooling device 27 and also connected to the heat-source-side expansion valve 24 and the liquid refrigerant shut-off valve 28 through the bridge circuit 25.

The bridge circuit 25 comprises four check valves 25*a* to 25*d* connected between the heat-source-side expansion valve 24 and the receiver 26. The bridge circuit 25 is configured such that, regardless of whether the refrigerant flowing between the heat-source-side heat exchanger 23 and the user-side heat exchangers 52 flows into the receiver 26 from the heat-source-side heat exchanger 23 or into the receiver 26 from the user-side heat exchangers 52, the refrigerant flows into the receiver 26 from the inlet of the receiver 26 and is returned to the flow path between the heat-source-side heat exchanger 23 and the user-side heat exchangers 52 from the outlet of the receiver 26. More specifically, the check valve 25*a* is connected so as to direct the refrigerant flowing from the user-side heat exchangers 52 toward the heat-source-side heat exchanger 23 to the inlet of the receiver 26. The check valve 25*b* is connected so as to direct the refrigerant flowing from the heat-source-side heat exchanger 23 toward the user-side heat exchangers 52 to the inlet of the receiver 26. The check valve 25*c* is connected such that refrigerant that has flowed through the cooling device 27 after exiting the outlet of the receiver 26 can flow toward the user-side heat exchangers 52. The check valve 25*d* is connected such that refrigerant that has flowed through the cooling device 27 after exiting the outlet of the receiver 26 can flow toward the heat-source-side heat exchanger 23. As a result, the refrigerant flowing between the heat-source-side heat exchanger 23 and the user-side heat exchanger 52 always flows into the inlet of the receiver 26 and is returned to the flow path between the heat-source-side heat exchanger 23 and the user-side heat exchanger 52 after flowing out from the outlet of the receiver 26.

The liquid refrigerant shut-off valve 28 and the gaseous refrigerant shut-off valve 29 are connected to the liquid refrigerant communication pipe 6 and the gaseous refrigerant communication pipe 7, respectively. The liquid refrigerant communication pipe 6 connects the user-side expansion valves 51 of the user units 5 to the liquid refrigerant shut-off valve 28 of the heat source unit 2. The gaseous refrigerant communication pipe 7 connects the gas sides of the user-side heat exchangers 52 of the user units 5 to liquid refrigerant shut-off valve 29 of the heat source unit 2.

The refrigerant circuit comprising the user-side expansion valves 51, user-side heat exchangers 52, compressor 21, four-way selector valve 22, heat-source-side heat exchanger 23, heat-source-side expansion valve 24, bridge circuit 25, receiver 26, liquid refrigerant shut-off valve 28, and gaseous refrigerant shut-off valve 29 all connected together sequentially constitutes a main refrigerant circuit 10 of the air conditioner 1.

The cooling device 27 and the bypass refrigerant circuit 41 will now be explained.

In this embodiment, the cooling device 27 is a double pipe heat exchanger provided for the purpose of cooling the refrigerant that flows to the user-side heat exchangers 52 after being condensed in the heat-source-side heat exchanger 23. In this embodiment, the cooling device 27 is connected between the receiver 26 and the bridge circuit 25.

The bypass refrigerant circuit 41 is connected to the main refrigerant circuit 10 and configured such that a portion of the refrigerant flowing from the heat-source-side heat exchanger 23 to the user-side heat exchangers 52 is diverted from the main refrigerant circuit 10 and returned to the intake side of the compressor 21. More specifically, the bypass refrigerant circuit 41 comprises a branch circuit 41*a* that branches from the circuit portion connecting the outlet of the receiver 26 to the check valve 25*d* of the bridge circuit 25 and connects to the inlet of the cooling device 27 and a merge circuit 41*b* that is connected from the outlet of the cooling device 27 to the intake pipe 31 of the compressor 21 so that refrigerant exiting the cooling device 27 is returned to the intake side of the compressor 21. A bypass expansion valve 42 (bypass expansion mechanism) is provided in the branch circuit 41*a* for the purpose of regulating the flow rate of the refrigerant flowing through the bypass refrigerant circuit 41. In this embodiment, the bypass expansion valve 42 is an electric powered expansion valve serving to regulate the flow rate of the refrigerant allowed to flow into the cooling device 27. As a result, the refrigerant flowing through the main refrigerant circuit 10 is cooled in the cooling device 21 by the refrigerant that is returned to the intake pipe 31 of the compressor 27 from the outlet of the bypass expansion valve 42.

Figure 2:
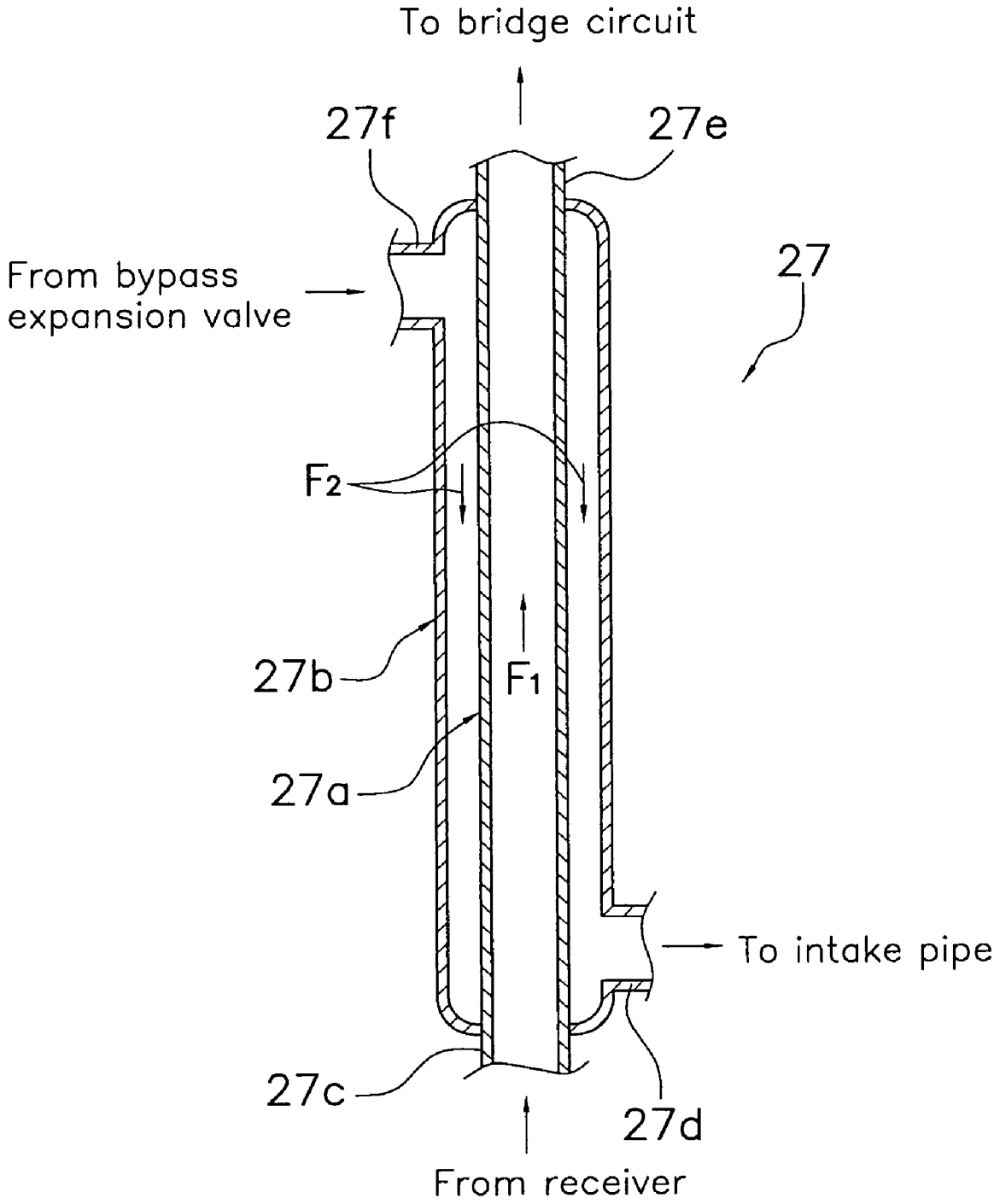
FIG. 2 is a cross sectional schematic view showing the structure of the cooling device of the air conditioner.

The cooling device 27 is a heat exchanger having flow passages configured such that the refrigerant flowing through the main refrigerant circuit 10 side flows in a direction that opposes the flow direction of the refrigerant flowing through the bypass refrigerant circuit 41 side. More specifically, as shown in FIG. 2, the cooling device 27 has a first pipe section 27*a* having one end connected to the receiver 26 and the other end connected to the bridge circuit 25 so as to carry the refrigerant flowing through the main refrigerant circuit side; and a second pipe section 27*b* arranged so as to cover the outside of the first pipe section 27*a* and having one end connected to the bypass expansion valve 42 and the other end connected to the intake pipe 31 of the compressor 21 so as to carry the refrigerant flowing through the bypass refrigerant circuit side. The pipe sections are arranged such that the inlet end 27*c* of the first pipe section 27*a* (which is connected to the receiver 26) corresponds to the outlet end 27*d* of the second pipe section 27*b* (which is connected to the intake pipe 31). Meanwhile, the outlet end 27*e* of the first pipe section 27*a* (which is connected to the bridge circuit 25) corresponds to the inlet end 27*f* of the second pipe section 27*b* (which is connected to the bypass expansion valve 24). Thus, the refrigerant flowing through the main refrigerant circuit side (indicated with an arrow F1 in FIG. 2) and the refrigerant flowing through the bypass refrigerant circuit side (indicated with arrows F2 in FIG. 2) flow in opposing directions. As a result, the refrigerant flowing through the main refrigerant circuit 10 can be cooled to a temperature that is lower than the outlet temperature of the refrigerant flowing through the bypass refrigerant circuit 41.

The air conditioner 1 has pressure sensors and temperature sensors provided in various locations and a control unit 60 (see FIG. 3) configured to control the various devices of the system based on detection signals from the sensors so that the system can be operated in such air conditioning modes as cooling mode and heating mode. The sensors and the control unit 60 will now be described.

First, the pressure sensors and temperature sensors provided in the air conditioner 1 will be described.

A low-pressure refrigerant pressure sensor LP is provided in the intake pipe 31 of the compressor 21 for detecting the pressure of the low-pressure gaseous refrigerant flowing on the intake side of the compressor 21. A high-pressure refrigerant pressure sensor HP is provided in the discharge pipe 32 of the compressor 21 for detecting the pressure of the high-pressure gaseous refrigerant flowing on the discharge side of the compressor 21. A high-pressure pressure switch HPS is provided in the discharge pipe 32 of the compressor 21 for detecting excessive increases in the pressure of the high-pressure gaseous refrigerant.

A high-pressure refrigerant temperature sensor Td (discharge temperature detecting mechanism) is provided in the discharge pipe 32 of the compressor 21 for detecting the temperature of the refrigerant at the discharge side of the compressor 21. An outdoor temperature sensor Ta is provided in the air intake vent of the outdoor fan 30 of the heat source unit 2 for detecting the temperature of the outdoor air. A heat-source-side heat exchange temperature sensor Tb is provided with respect to the heat-source-side heat exchanger 23 for detecting a refrigerant temperature that corresponds to the condensation temperature of the refrigerant during cooling mode and the evaporation temperature of the refrigerant during heating mode. A cooling device outlet bypass refrigerant temperature sensor Tsh (superheating degree detecting mechanism) is provided in the merge circuit 41*b* of the bypass refrigerant circuit 41 for detecting the superheating degree of the refrigerant flowing through the portion of the bypass refrigerant circuit 41 that is situated on the outlet side of the cooling device 27. An indoor temperature sensor Tr is provided in the air intake vent of the indoor fan 53 of each user unit 5 for detecting the temperature of the indoor air. A user-side heat exchange temperature sensor Tn is provided with respect to the heat-source-side heat exchanger 52 for detecting a refrigerant temperature that corresponds to the evaporation temperature of the refrigerant during cooling mode and the condensation temperature of the refrigerant during heating mode.

Figure 3:
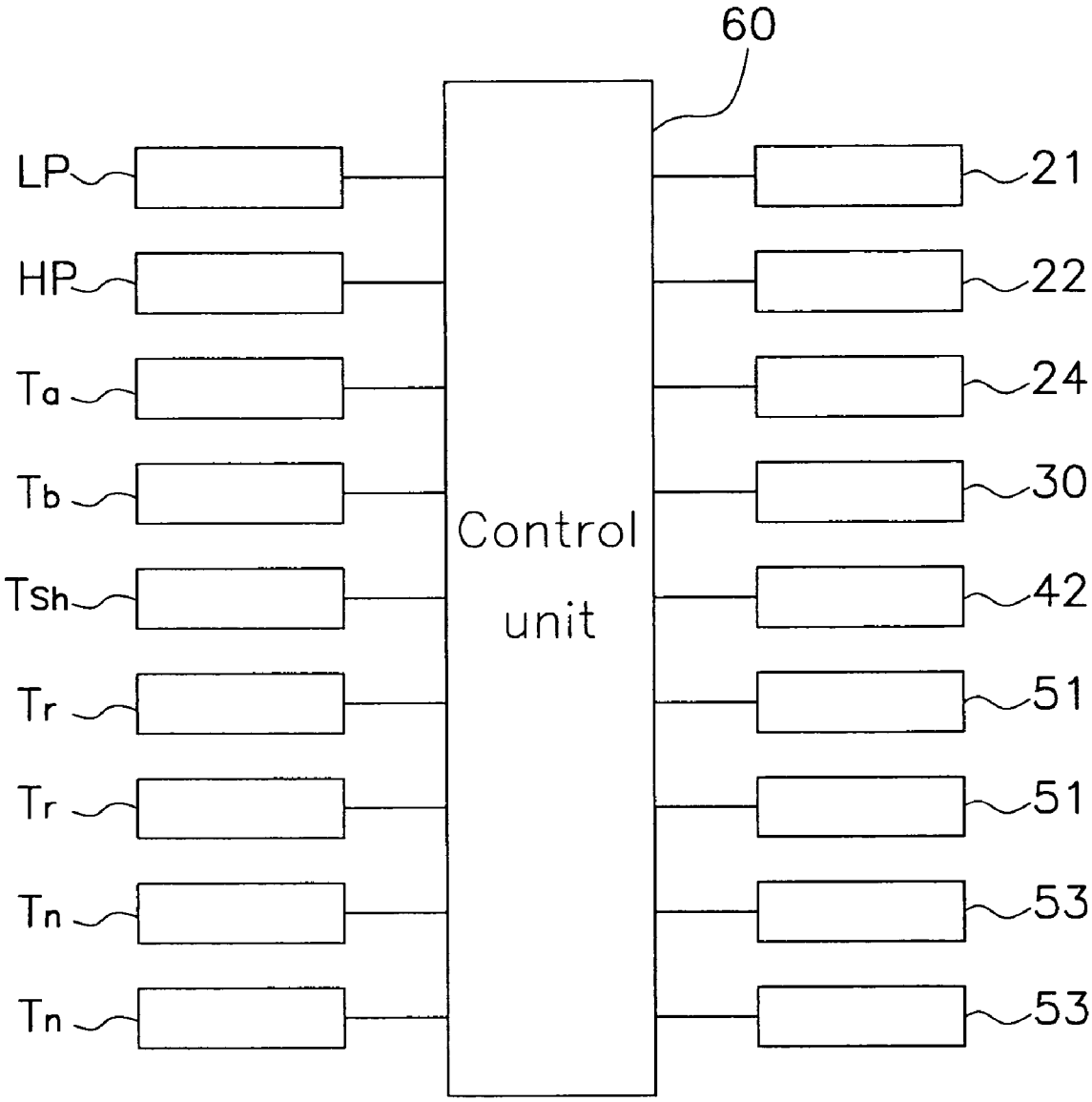
FIG. 3 is a block diagram of the control unit of the air conditioner.

Next, control unit 60 will be explained. The control unit 60 comprises chiefly a microcomputer that, as indicated in FIG. 3, is connected such that it can receive input signals from the aforementioned pressure sensors LP, HP and temperature sensors Td, Ta, Tb, Tsh, Tr and control the various devices and valves 21, 22, 24, 30, 42, 51, 53 based on these input signals. The control unit 60 controls the devices and valves to operate the system in cooling mode or heating mode and also functions as a bypass expansion valve control means for controlling the bypass expansion valve 42 provided in the bypass refrigerant circuit 41. More specifically, the bypass expansion valve control means of the control unit 60 has a function for executing superheating degree control whereby the refrigerant flowing through the main refrigerant circuit 10 is subcooled using the cooling device 27 and the bypass refrigerant circuit 41 by directing a portion of the refrigerant flowing through the main refrigerant circuit 10 to the bypass refrigerant circuit 41 (which is configured to return said portion to the intake pipe 31 of the compressor 21) and allowing the bypass refrigerant to exchange heat with the refrigerant flowing through the main refrigerant circuit 10 in the cooling device 27. The bypass expansion valve control means of the control unit 60 also has a function for executing overheating prevention control whereby the system is prevented from operating in a state in which the temperature of the refrigerant at the discharge side of the compressor 21 is excessively high (hereinafter called "overheating").

When it executes superheating degree control, the control unit 60 controls the opening degree of the bypass expansion valve 42 based on the value of the superheating degree of the refrigerant flowing in the bypass refrigerant circuit 41 detected by the cooling device outlet bypass refrigerant temperature sensor Tsh (hereinafter called the "measured superheating degree tSHa") such that the measured superheating degree tSHa of the refrigerant flowing in the bypass refrigerant circuit 41 is substantially equal to a prescribed superheating degree value (hereinafter called the "target superheating degree tSHs"). In this embodiment, the measured superheating degree tSHa is the value obtained by subtracting the saturation temperature value of the refrigerant calculated based on the pressure value of the low-pressure gaseous refrigerant detected by the low-pressure refrigerant pressure sensor LP from the temperature value of the refrigerant flowing in the bypass refrigerant circuit 41 detected by the cooling device outlet bypass refrigerant temperature sensor Tsh. The value of the target superheating degree tSHs is set based on the value of the discharge temperature of the high-pressure gaseous refrigerant detected by the high-pressure refrigerant temperature sensor Td (hereinafter called the "measured discharge temperature td) to such a value that the system does not operate in a state in which liquid refrigerant is drawn into the compressor 21 (hereinafter called "wet compression"). In this embodiment, the value of the target superheating degree tSHs is varied such that the measured discharge temperature td is brought close to a prescribed discharge temperature value (hereinafter called the "target discharge temperature tds"). More specifically, the target superheating degree tSHs is varied such that it becomes smaller when the measured discharge temperature td is higher than the target discharge temperature tds and larger when the measured discharge temperature td is lower than the target discharge temperature tds. Additionally, the target discharge temperature tds is set to a temperature value slightly higher than the outlet temperature value at which the compressor 21 will begin to undergo wet compression (hereinafter called the "minimum allowed discharge temperature tdm").

The control unit 60 also executes overheating prevention control when the measured discharge temperature td reaches or exceeds an excessively high temperature (hereinafter called the "maximum allowed discharge temperature tdx), thereby controlling the opening degree of the bypass expansion valve 42 such that the measured discharge temperature td is reduced to a temperature lower than the maximum allowed discharge temperature tdx. Once the value of the measured discharge temperature td is restored to a temperature lower than the maximum allowed discharge temperature tdx, the control unit 60 returns to executing superheating degree control.

Thus, while the conditions under which the controls are executed are different, the control unit 60 functions to control the opening degree of the bypass expansion valve 42 both when it executes superheating degree control and when it executes overheating prevention control. In other words, the control unit 60 executes superheating degree control when the measured discharge temperature td is higher than the minimum allowed discharge temperature tdm and lower than the maximum allowed discharge temperature tdx and executes overheating prevention control when the measured discharge temperature td is equal to or higher than the maximum allowed discharge temperature tdx.

In this way, the bypass refrigerant circuit 41 functions both to cool the refrigerant flowing through the main refrigerant circuit 10 to a subcooled state and to prevent the compressor 21 from overheating.

Figure 4:
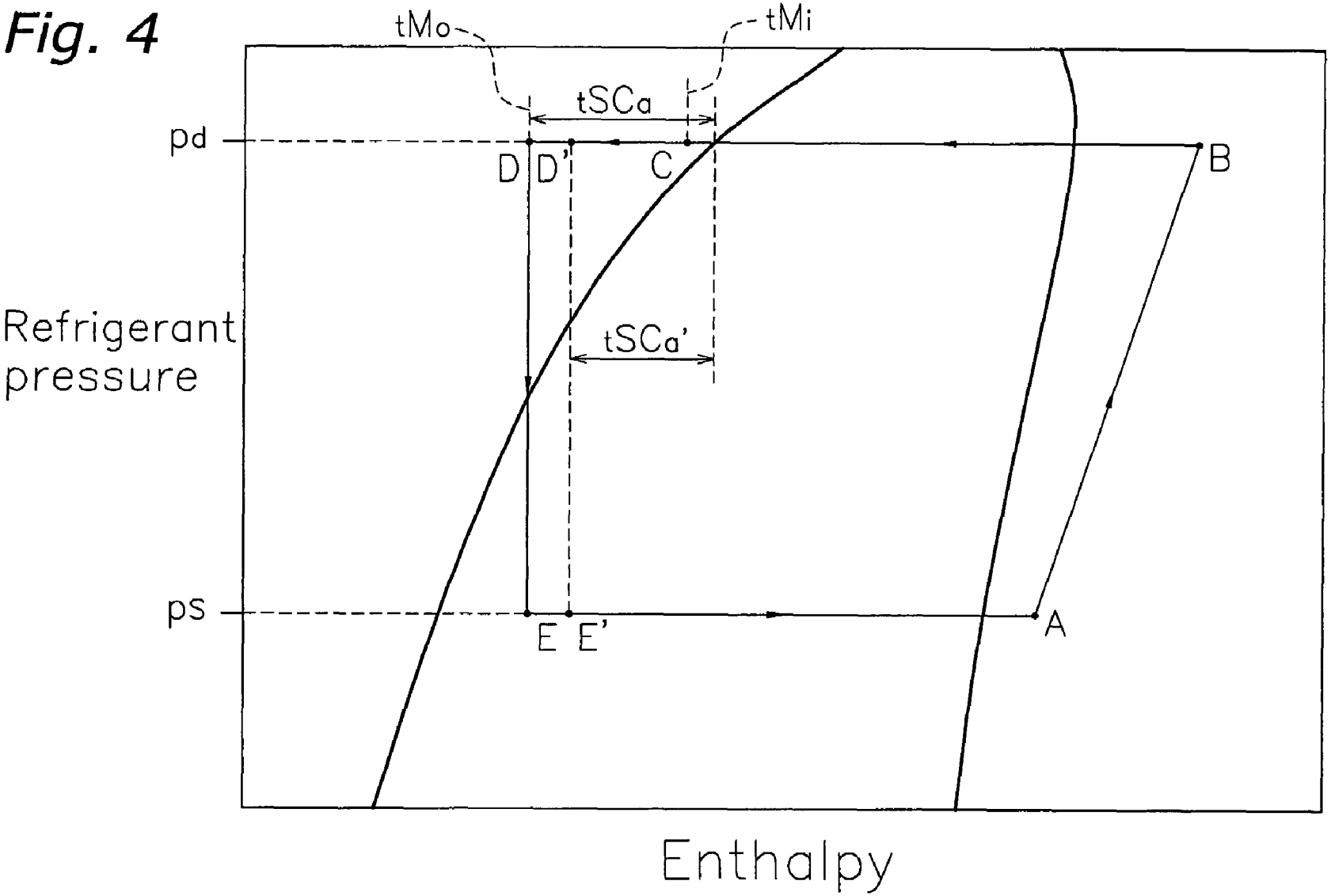
FIG. 4 is a Mollier diagram showing the refrigeration cycle of the air conditioner during cooling mode.
Figure 5:
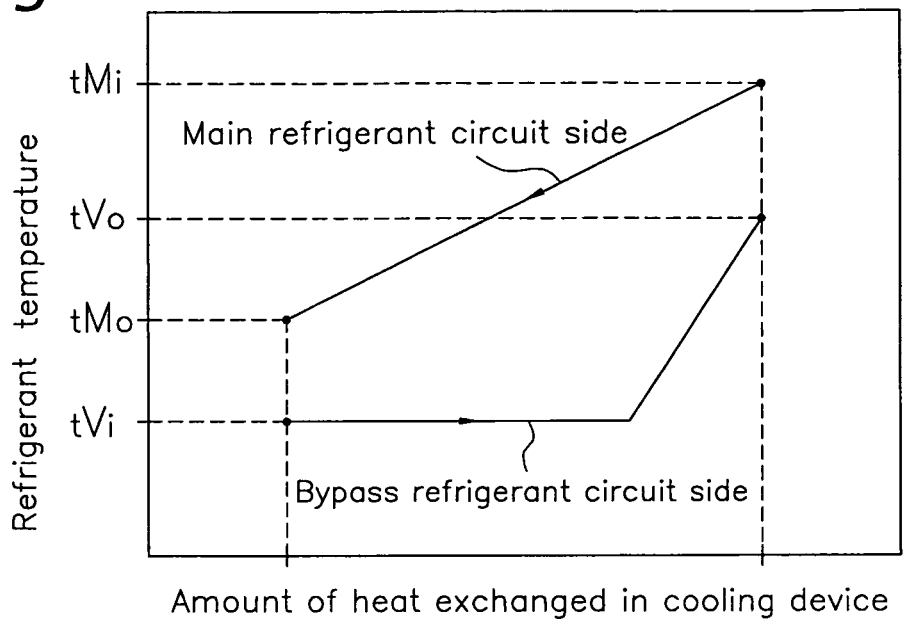
FIG. 5 is a plot of the refrigerant temperature versus the amount of exchanged heat and serves to indicate the state of the heat exchange between the refrigerant flowing through the main refrigerant circuit side of the cooling device and the refrigerant flowing through the bypass refrigerant circuit side of the cooling device.
Figure 6:
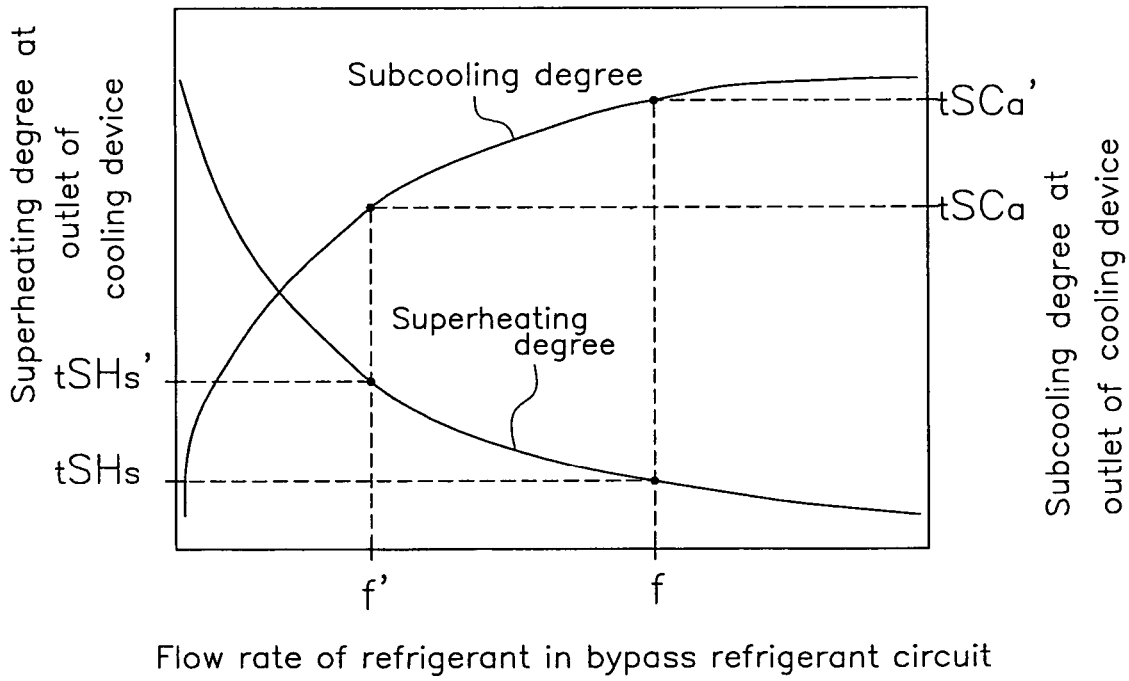
FIG. 6 is a plot showing the relationships among the flow rate of the refrigerant flowing through the bypass refrigerant circuit, a value (tSHa) indicating the superheating degree of the refrigerant flowing through the bypass refrigerant circuit, and a value (tSCa) indicating the subcooling degree of the refrigerant flowing through the main refrigerant circuit.

The operation of the air conditioner 1 in cooling mode will now be described using FIG. 1 and FIGS. 4 to 6. FIG. 4 is a Mollier diagram showing the refrigeration cycle of the air conditioner 1 during cooling mode. FIG. 5 is a plot of the refrigerant temperature versus the amount of exchanged heat and serves to indicate the state of the heat exchange between the refrigerant flowing through the main refrigerant circuit 10 side of the cooling device 27 and the refrigerant flowing through the bypass refrigerant circuit 41 side of the cooling device 27. FIG. 6 is a plot showing the relationships among the flow rate of the refrigerant flowing through the bypass refrigerant circuit 41, the value (tSHa) indicating the superheating degree of the refrigerant flowing through the bypass refrigerant circuit 41, and the value (tSCa) indicating the subcooling degree of the refrigerant flowing through the main refrigerant circuit 10.

During cooling mode, the four-way selector valve 22 is in the state indicated with solid lines in FIG. 1, i.e., in such a state that the discharge side of the compressor 21 is connected to the gas side of the heat-source-side heat exchanger 23 and the intake side of the compressor 21 is connected to the gaseous refrigerant shut-off valve 29. Also, the liquid refrigerant shut-off valve 28 and the gaseous refrigerant shut-off valve 29 are opened and the opening degree of the user-side expansion valves 51 is adjusted to reduce the pressure of the refrigerant. The heat-source-side expansion valve 24 is open and the opening degree of the bypass expansion valve 42 is adjusted by the bypass expansion valve control means of the control unit 60.

When the outdoor fan 30 of the heat source unit 2, the compressor 21, and the indoor fans 53 of the user units 5 are started up with the main refrigerant circuit 10 and the bypass refrigerant circuit 41 in the state just described, the low-pressure gaseous refrigerant is drawn into the compressor 21 from the intake pipe 31 and compressed from a pressure ps to a pressure pd (see point A and point B in FIG. 4). Then, the compressed gaseous refrigerant passes through the four-way selector valve 22 and into the heat-source-side heat exchanger 23, where it is cooled and condensed by exchanging heat with the outdoor air. The refrigerant is cooled to the saturation temperature or slightly below the saturation temperature (see point C in FIG. 4). The condensed refrigerant passes through the heat-source side expansion valve 24 and the check valve 25*b* of the bridge circuit 25 and flows into the receiver 26. After collected temporarily in the receiver 26, the liquid refrigerant flows into the cooling device 27, where it is cooled to a subcooled state by exchanging heat with the refrigerant flowing through the bypass refrigerant circuit 41 side of the cooling device 27 (see point D and the subcooling degree tSCa in FIG. 4). The subcooled refrigerant then passes through the check valve 25*c* of the bridge circuit 25, the liquid refrigerant shut-off valve 28, and the liquid refrigerant communication pipe 6 and flows into the user units 5. In the user units 5, the pressure of the refrigerant is reduced by the user-side expansion valves 51 (see point E in FIG. 4) and the refrigerant is evaporated in the user-side heat exchangers 52 by exchanging heat with the indoor air (see point A in FIG. 4). The now gaseous refrigerant passes through the gaseous refrigerant communication pipe 7, the gaseous refrigerant shut-off valve 29, and the four-way selector valve 22 and is again drawn into the compressor 21.

During this cycle, a portion of the liquid refrigerant collected in the receiver 26 is diverted from the main refrigerant circuit 10 to the bypass refrigerant circuit 41 and returned to the intake pipe 31 of the compressor 21. The flow rate of the diverted refrigerant is regulated by the bypass expansion valve 42. The pressure of the refrigerant that passes through the bypass expansion valve 42 is reduced to approximately the pressure ps and, consequently, a portion of the refrigerant evaporates. The refrigerant that flows from the outlet of the bypass expansion valve 42 toward the intake pipe 31 of the compressor 21 in the bypass refrigerant circuit 41 passes through the cooling device 27 and exchanges heat with the liquid refrigerant flowing from the heat-source-side heat exchanger 23 to the user-side heat exchangers 52 in the main refrigerant circuit 10. The temperature of the refrigerant exiting the bypass expansion valve 42 (see temperature tVi in FIG. 5) is lower than the temperature of the refrigerant flowing from the heat-source-side heat exchanger 23 to the user-side heat exchangers 52 in the main refrigerant circuit 10 (see temperature tMi in FIGS. 4 and 5). Consequently, as shown in FIGS. 4 and 5, the liquid refrigerant flowing from the heat-source-side heat exchanger 23 to the user-side heat exchangers 52 in the main refrigerant circuit 10 is cooled to a temperature tMo and the refrigerant flowing through the bypass refrigerant circuit 41 is heated to a temperature tVo.

The control unit 60 executes superheating degree control of the opening degree of the bypass expansion valve 42 based on the measured superheating degree tSHa detected by the cooling device outlet bypass refrigerant temperature sensor Tsh such that the measured superheating degree tSHa of the refrigerant flowing through the bypass refrigerant circuit 41 is substantially equal to the target superheating degree tSHs. As a result, the refrigerant flowing through the bypass refrigerant circuit 41 passes through the cooling device 27 and is heated to the target superheating degree tSHs before it returns to the intake pipe 31 of the compressor 21. The value of the target superheating degree tSHs is varied based on the discharge temperature value td of the high-pressure gaseous refrigerant detected by the high-pressure refrigerant temperature sensor Td to such the target discharge temperature tds that wet compression does not occur in the compressor 21. As a result, when the refrigerant flowing through intake pipe 31 of the compressor 21 in the main refrigerant circuit 10 is sufficiently superheated even after the refrigerant from the bypass refrigerant circuit 41 (which has passed through the cooling device 27) merges therewith, i.e., when the value of the discharge temperature td is higher than the target discharge temperature tds, the value of the target superheating degree tSHs is reduced so that the opening degree of the bypass expansion valve 42 is increased and, thus, the flow rate of the refrigerant flowing through the bypass refrigerant circuit 41 is increased. Since, as shown in FIG. 6, the measured subcooling degree tSCa increases as the measured superheating degree tSHa decreases, reducing the value of the target superheating degree tSHs has the effect of accelerating the exchange of heat taking place in the cooling device 27 and increasing the subcooling degree of the refrigerant flowing through the main refrigerant circuit 10. Conversely, if the value of the discharge temperature td is lower than the target discharge temperature tds and there is the possibility that wet compression will occur, the value of the target superheating degree tSHs is increased so that the opening degree of the bypass expansion valve 42 is decreased and, thus, the flow rate of the refrigerant flowing through the bypass refrigerant circuit 41 is decreased, increasing the value of the target superheating degree tSHs has the effect of suppressing the exchange of heat in the cooling device 27 and decreasing the subcooling degree of the refrigerant flowing through the main refrigerant circuit 10. By executing superheating degree control of the bypass expansion valve 42 in this manner, the subcooling degree tSCa of the refrigerant flowing through the main refrigerant circuit 10 can be increased by increasing the flow rate of refrigerant flowing through the bypass refrigerant circuit 41 so as to accelerate the exchange of heat in the cooling device 27.

Depending on the operating conditions of the air conditioner 1, the discharge temperature td of the high-pressure refrigerant gas detected by the high-pressure refrigerant temperature sensor Td will sometimes become equal to or higher than the maximum allowed discharge temperature tdx. In such cases, the bypass expansion valve control means of the control unit 60 switches from executing superheating degree control to executing overheating prevention control of the bypass expansion valve 42. More specifically, the bypass expansion valve control means controls the opening degree of the bypass expansion valve 42 such that the discharge temperature td is reduced to a temperature below the maximum allowed discharge temperature tdx. As a result, the temperature of the refrigerant at the intake side of the compressor 21 decreases and the discharge temperature value td is returned to a temperature that is lower than the maximum allowed discharge temperature tdx. Since this control is accomplished by increasing the opening degree of the bypass expansion valve 42 to an opening degree that is larger than the opening degree the bypass expansion valve 42 had when it was detected that the discharge temperature td was equal to or larger than the maximum allowed discharge temperature tdx, the refrigerant flowing through the main refrigerant circuit 10 side of the cooling device 27 continues to be subcooled. Once the value of the discharge temperature td is restored to a temperature lower than the maximum allowed discharge temperature tdx, the bypass expansion valve control means of the control unit 60 switches back to executing superheating degree control.

The air conditioner 1 in accordance with this embodiment has the following characteristic features.

In conventional superheating degree control, the bypass expansion valve 42 is not controlled based on the discharge temperature td of the running air conditioner 1 (as shown in FIG. 6) when the refrigerant flowing through the portion of the main refrigerant circuit 10 on the intake side of the compressor 21 is sufficiently superheated even after the refrigerant from the bypass refrigerant circuit 41 (which has passed through the cooling unit 27) merges therewith. Consequently, the target superheating degree tSHs' cannot be lowered to as small a value as the target superheating degree tSHs of this embodiment because of the risk of causing wet compression to occur. Consequently, as shown in FIG. 4, the subcooling degree of the refrigerant flowing through the portion of the main refrigerant circuit 10 downstream of the cooling device 27 cannot be increased beyond the subcooling degree tSCa', which is smaller than the subcooling degree tSCa obtained with this embodiment.

However, the air conditioner 1 of this embodiment is configured such that the value of target superheating degree tSHs used by the bypass expansion valve control means of the control unit 60 to control the bypass expansion valve 42—and, thus, control the superheating degree tSHa of the refrigerant flowing through the bypass refrigerant circuit 41—can be set based on the discharge temperature td of the compressor 21 detected by the high-pressure refrigerant temperature sensor Td to a value in a range where wet compression does not occur in the compressor 21 (i.e., the target superheating degree tSHs can be set such that the measured discharge temperature td is brought close to the target discharge temperature tds). As a result, by reducing the value of the target superheating degree tSHs to such an extent that does not cause wet compression to occur in the compressor 21, the flow rate of the refrigerant flowing through the bypass refrigerant circuit 41 can be increased to a flow rate f that is larger than the flow rate f' obtained with the conventional superheating degree control, thereby accelerating the exchange of heat in the cooling device 27 and increasing the subcooling degree of the refrigerant flowing through the main refrigerant circuit 10.

With the air conditioner 1 of this embodiment, when the discharge temperature td detected by the high-pressure refrigerant temperature sensor Td is smaller than a prescribed value (i.e., the maximum allowed discharge temperature tdx), the bypass expansion valve control means of the control unit 60 controls the bypass expansion valve 42 such that the superheating degree tSHa of the refrigerant flowing through the bypass refrigerant circuit 41 is kept within a range where wet compression does not occur in the compressor 21. Meanwhile, when the discharge temperature td detected by the high-pressure refrigerant temperature sensor Td is equal to or higher than the maximum allowed discharge temperature tdx, instead of controlling the superheating degree tSHa of the refrigerant flowing through the bypass refrigerant circuit 41, the bypass expansion valve control means controls the bypass expansion valve 42 such that the discharge temperature td detected by the high-pressure refrigerant temperature sensor Td decreases to a temperature lower than the maximum allowed discharge temperature tdx.

As a result, control that prevents the compressor 21 from operating in an overheated state can be executed while executing control that increases the subcooling degree tSCa of the refrigerant flowing in the main refrigerant circuit 10 by controlling the superheating degree tSHa of the refrigerant flowing in the bypass refrigerant circuit 41. Additionally, the cost of the air conditioner 1 can be reduced because it is not necessary to provide a separate refrigerant circuit for preventing overheating of the compressor 21.

With the air conditioner 1 of this embodiment, the refrigerant flowing through the main refrigerant circuit 10 side of the cooling device 27 can be cooled to a temperature tMo that is lower than the outlet temperature tVo of the refrigerant flowing through the bypass refrigerant circuit 41 side because the cooling device 27 is a heat exchanger configured such that the refrigerant flowing through the main refrigerant circuit side 10 thereof flows in a direction that opposes the flow direction of the refrigerant flowing through the bypass refrigerant circuit 41 side.

As a result, the cold energy of the refrigerant flowing in the bypass refrigerant circuit 41 is used more efficiently and the subcooling degree tSCa of the refrigerant flowing in the main refrigerant circuit 10 can be increased even further.

When the air conditioner 1 of this embodiment is operating in cooling mode, the condensed refrigerant leaving the heat-source-side heat exchanger 23 is subcooled by the cooling device 27 and delivered to the user units 5 via the liquid refrigerant communication pipe 6, after which it is expanded inside the user units 5.

As a result, the refrigerant flowing through the liquid refrigerant communication pipe 6 can be prevented from evaporating due to low pressure and turning into a dual-phase refrigerant flow even if the liquid refrigerant communication pipe 6 is long or the user units 5 are installed in a higher position than the heat source unit 2. Consequently, abnormal noises occurring as the refrigerant passes through the user-side expansion valves 51 of the user units 5 can be reduced.

Also, the occurrence of an uneven flow distribution of refrigerant to the plurality of user units 5 (two in this embodiment) can be prevented because the condensed refrigerant exiting the heat-source-side heat exchanger 23 is cooled to a subcooled state in the cooling device 27 before being delivered to the user units 5 in a branched manner through the liquid refrigerant communication pipe 6.

In the previously described embodiment, the control unit 60 uses the value of the discharge temperature td detected by the high-pressure refrigerant temperature sensor Td as the condition for executing overheating prevention control. However, it is also acceptable to increase the control precision by setting a maximum allowed value for the superheating degree of the refrigerant at the discharge side of the compressor 21 and using the maximum allowed value as the condition for executing overheating prevention control. In such a case, the superheating degree at the discharge side of the compressor 21 is the value obtained by subtracting the saturation temperature value of the refrigerant calculated based on the pressure value of the high-pressure gaseous refrigerant detected by the high-pressure refrigerant pressure sensor HP from the value of the discharge temperature td detected by the high-pressure refrigerant temperature sensor Td.

In the previously described embodiment, when the control unit 60 executes superheating degree control, it varies the target superheating degree tSHs in such a manner that the value of the discharge temperature td detected by high-pressure refrigerant temperature sensor Td is brought close to the target discharge temperature tds. However, it is also acceptable to execute the superheating degree control using a function that expresses a relationship between the value of the target superheating degree tSHs and the value of the discharge temperature td. By using such an approach, the stability of the superheating degree control can be increased.

Although an embodiment of the present invention and variations thereof have been described herein with reference to the drawings, the specific constituent features of the invention are not limited to those of these embodiments and variations and modifications can be made within a scope that does not deviate from the gist of the invention.

For example, although the previously described embodiment illustrates an application of the invention to an air conditioner configured such that it can switch between a cooling mode and a heating mode, the invention is not limited to such an application. Rather, the invention can be applied to other air conditioners and refrigeration systems, such as air conditioners configured to operate exclusively in cooling mode and air conditioners configured such that they can operate in cooling mode and heating mode simultaneously.

When the present invention is employed, it becomes possible to increase the subcooling degree of the refrigerant flowing through the main refrigerant circuit in a refrigeration system configured such that a portion of the refrigerant flowing in a main refrigerant circuit can be made to bypass the remainder of the main refrigerant circuit so as to return to the intake side of a compressor and used to cool the refrigerant flowing in the main refrigerant circuit to a subcooled state.

What is claimed is:

1. A refrigeration system comprising:

a main refrigeration circuit including a compressor, a heat-source-side heat exchanger and a user-side heat exchanger;

a discharge temperature detecting mechanism provided in the main refrigerant circuit and configured to detect a discharge temperature of the refrigerant at a discharge side of the compressor;

a bypass refrigerant circuit connected to the main refrigerant circuit and configured such that a portion of the refrigerant flowing from the heat-source-side heat exchanger to the user-side heat exchanger is diverted from the main refrigerant circuit and returned to an intake side of the compressor;

a bypass expansion mechanism provided in the bypass refrigerant circuit and configured to regulate a flow rate of the refrigerant flowing through the bypass refrigerant circuit;

a cooling device configured and arranged to cool the refrigerant flowing from the heat-source-side heat exchanger to the user-side heat exchanger in the main refrigerant circuit using the refrigerant that exits the bypass expansion mechanism and flows to the intake side of the compressor;

a superheating degree detecting mechanism provided in the bypass refrigerant circuit and configured to detect a superheating degree of the refrigerant at an outlet side of the cooling device; and an expansion mechanism control device configured to control the bypass expansion mechanism based on the superheating degree detected by the superheating degree detecting mechanism such that the superheating degree of the refrigerant flowing through the bypass refrigerant circuit is substantially equal to a prescribed superheating degree, the value of the prescribed superheating degree being set based on the discharge temperature detected by the discharge temperature detecting mechanism such that wet compression does not occur in the compressor.

2. The refrigeration system according to claim 1, wherein when the discharge temperature detected by the discharge temperature detecting mechanism is equal to or higher than a prescribed value, the expansion mechanism control device controls the bypass expansion mechanism such that the discharge temperature is reduced to a temperature lower than the prescribed value.

3. The refrigeration system according to claim 2, wherein the cooling device is a heat exchanger having flow passages configured such that the refrigerant flowing through a main refrigerant circuit side of the heat exchanger flows in a direction that opposes the flow direction of the refrigerant flowing through a bypass refrigerant circuit side.

4. The refrigeration system according to claim 3, wherein the main refrigerant circuit further includes a heat source unit having the compressor, the heat-source-side heat exchanger, and the cooling device and a user unit including the user-side heat exchanger, the user unit and the heat source unit are connected together by a liquid refrigerant communication pipe and a gaseous refrigerant communication pipe, and the user unit has a user-side expansion mechanism that is connected to a liquid refrigerant communication pipe side of the user-side heat exchanger and is configured to regulate a flow rate of the refrigerant flowing through the user unit.

5. The refrigeration system according to claim 4, wherein a plurality of user units are provided, the user units are arranged in parallel and connected to the heat source unit via the liquid refrigerant communication pipe and the gaseous refrigerant communication pipe.

6. The refrigeration system according to claim 2, wherein the main refrigerant circuit further includes a heat source unit having the compressor, the heat-source-side heat exchanger, and the cooling device and a user unit including the user-side heat exchanger, the user unit and the heat source unit are connected together by a liquid refrigerant communication pipe and a gaseous refrigerant communication pipe, and the user unit has a user-side expansion mechanism that is connected to a liquid refrigerant communication pipe side of the user-side heat exchanger and is configured to regulate a flow rate of the refrigerant flowing through the user unit.

7. The refrigeration system according to claim 6, wherein a plurality of user units are provided, the user units are arranged in parallel and connected to the heat source unit via the liquid refrigerant communication pipe and the gaseous refrigerant communication pipe.

8. The refrigeration system according to claim 1, wherein the cooling device is a heat exchanger having flow passages configured such that the refrigerant flowing through a main refrigerant circuit side of the heat exchanger flows in a direction that opposes the flow direction of the refrigerant flowing through a bypass refrigerant circuit side.

9. The refrigeration system according to claim 8, wherein the main refrigerant circuit further includes a heat source unit having the compressor, the heat-source-side heat exchanger, and the cooling device and a user unit including the user-side heat exchanger, the user unit and the heat source unit are connected together by a liquid refrigerant communication pipe and a gaseous refrigerant communication pipe, and the user unit has a user-side expansion mechanism that is connected to a liquid refrigerant communication pipe side of the user-side heat exchanger and is configured to regulate a flow rate of the refrigerant flowing through the user unit.

10. The refrigeration system according to claim 9, wherein a plurality of user units are provided, the user units are arranged in parallel and connected to the heat source unit via the liquid refrigerant communication pipe and the gaseous refrigerant communication pipe.

11. The refrigeration system according to claim 1, wherein the main refrigerant circuit further includes a heat source unit having the compressor, the heat-source-side heat exchanger, and the cooling device and a user unit including the user-side heat exchanger, the user unit and the heat source unit are connected together by a liquid refrigerant communication pipe and a gaseous refrigerant communication pipe, and the user unit has a user-side expansion mechanism that is connected to a liquid refrigerant communication pipe side of the user-side heat exchanger and is configured to regulate a flow rate of the refrigerant flowing through the user unit.

12. The refrigeration system according to claim 11, wherein a plurality of user units are provided, the user units are arranged in parallel and connected to the heat source unit via the liquid refrigerant communication pipe and the gaseous refrigerant communication pipe.

* * * * *